US006378344B1

(12) United States Patent
Gartner

(10) Patent No.: US 6,378,344 B1
(45) Date of Patent: Apr. 30, 2002

(54) COMBINATION LOCK HANDLE

(76) Inventor: Klaus W. Gartner, 3330 Kashiwa St., Torrance, CA (US) 90505

( * ) Notice: Subject to any disclaimer, the term of this patent is extended or adjusted under 35 U.S.C. 154(b) by 0 days.

(21) Appl. No.: 09/664,265

(22) Filed: Sep. 18, 2000

(51) Int. Cl.[7] ..... E05B 49/00
(52) U.S. Cl. ..... 70/278.1; 70/213
(58) Field of Search ..... 70/278.1, 278.4, 70/282, 283, 208, 213; 340/825.31

(56) References Cited

U.S. PATENT DOCUMENTS 2,653,045 A * 9/1953 Pinderhughes ..... 292/169
3,545,238 A * 12/1970 Gehrie ..... 70/312
4,019,355 A * 4/1977 Germanton ..... 70/278
4,032,729 A * 6/1977 Koistinen ..... 200/5
4,770,012 A * 9/1988 Johansson ..... 70/278
4,852,371 A * 8/1989 Pfeiffer ..... 70/70
4,901,545 A * 2/1990 Bacon ..... 70/278
5,321,963 A * 6/1994 Goldman ..... 70/278
5,340,173 A * 8/1994 Bethel ..... 292/288
5,865,483 A * 2/1999 Dubraivin ..... 292/251.5
5,887,467 A * 3/1999 Butterweck ..... 70/278
6,038,895 A * 3/2000 Menke ..... 70/278.1
6,098,433 A * 8/2000 Maniaci ..... 70/278.1

* cited by examiner

*Primary Examiner*—Gary Estremsky
(74) *Attorney, Agent, or Firm*—Oppenheimer Wolff & Donnelly LLP

(57) ABSTRACT

An electronic combination lock handle includes a rotatable spindle which interacts with two bolts to permit locking and release. The position of the handle relative the door indicates whether the combination lock is in a bolted position or unbolted position. A pistol grip handle permits rotation of the spindle when a bolt initiation mechanism which can include a solenoid armature is free of the spindle. An electronic keypad for the combination lock is mounted in the face of the pistol grip handle. The solenoid armature shaft interacts with a rotatable spindle to inhibit or permit rotation of the shaft.

13 Claims, 6 Drawing Sheets

COMBINATION LOCK HANDLE

RELATED APPLICATION

This application relates to the following applications of the present Applicant. "ELECTRONIC INPUT AND KEY-PAD ENTRY LOCK" (U.S. Ser. No. 09/611,927, filed Jul. 7, 2000, which is a divisional of U.S. Ser. No. 08/627,799 filed Mar. 29,1996 now U.S. Pat. No. 6,116, 061, which is a continuation of U.S. Ser. No. 08/219,785, filed Mar. 30, 1994 and now abandoned; COMBINATION LOCK WITH TERMINALS FOR OPERATION WITH AN ADDITIONAL BATTERY (U.S. Ser. No. 09/634,218, filed Aug. 9, 2000).; and HANDLE WITH INPUT AND BATTERY COMPARTMENT, Design Patent Application (U.S. Ser. No. 29,129,609, filed contemporaneously with this application. The contents of those applications are incorporated by reference herein.

BACKGROUND OF THE INVENTION

The invention relates to combination locks. In particular, the present invention relates to an electronically activated lock, wherein there is a pad having indicia related to an electronic system located on a lock handle.

It is known to have the open or closed condition of the lock indicated by the mechanical orientation of a handle or the orientation of indicia on the handle. This, however, although an acceptable technique, is not the best manner of providing this indication.

The combination lock of the invention is electrically or battery operable. Such locks can be for use on safes or on doors. This invention is directed to providing an improved manner for operating an electrical or battery operated combination lock.

The invention is directed to minimizing the difficulties with known electrical and battery operated combination locks. The invention provides advances in being able to handle and operate the lock effectively and at the same time provide a readily realizable manner of indicating the open and closed condition of the lock. The lock of the invention also provides for a convenient manner of handling.

SUMMARY OF THE INVENTION

The present invention discloses and provides an electrical or battery powered combination lock mechanism for secure use to facilitate the convenient opening and closing of an electronic lock.

The electronic combination lock includes a digital operable keypad incorporated with a pistol grip or an elongated handle that operates the bolt. The pistol grip or elongated handle is intended to be held in the hand of a user such that the fingers embrace the grip or handle. The front of the grip or handle is directed to lie substantially within in the palm of the hand of the user. In this manner the grip or handle can be conventionally turned to operate the lock, and also open and close the door.

The handle has a pistol grip shape and incorporates the manually operable keypad on a face of the grip or elongated handle, preferably in a position remote from the free end of the pistol grip. Turning of the pistol grip by rotation about its axis retracts one or more locking bolts associated with a locking mechanism. The bolts are operated by a bolt-activating mechanism.

Generally stated, the present invention includes a lock, which includes a bolt-activating mechanism operable between a bolt-locking and a bolt-release condition. This is effected through entry of a lock-opening combination by digital input of a predetermined code to operate the locking mechanism. There is also a rotatable spindle or shaft with a formation to interact with the bolt-locking mechanism such that interaction with the spindle activates the one or more bolts to extend or retract relative to the locking position. When the spindle is permitted to rotate, after a correct combination is input to the key pad, the spindle is rotated, as the handle rotates. Rotation of the spindle permits the one or more bolts to move between the locking position and the release condition.

An electronic combination lock having a keypad with push buttons bearing indicia can indicate an open or closed condition of the lock, or the ability to turn the handle or lock the handle against rotation. The lock includes a housing that attaches through bolts on a door to which the lock is to be mounted.

With this invention it is easy to visualize the state of lock or unlock of the bolts, by viewing the position of the pistol handle. Also, by placing the indicia in a conveniently accessible place on the pistol handle, the operation of the lock can be easily effected both in its locking an unlocking characteristic and also in its turning ability about an axis.

The lock also includes a battery for operating the lock-activating mechanism. There are terminals on a front face of the housing for the lock for connection to a supplemental backup battery.

The invention is further described with reference to the accompanying drawings.

DETAILED DESCRIPTION OF THE PREFERRED EMBODIMENT

Figure 1:
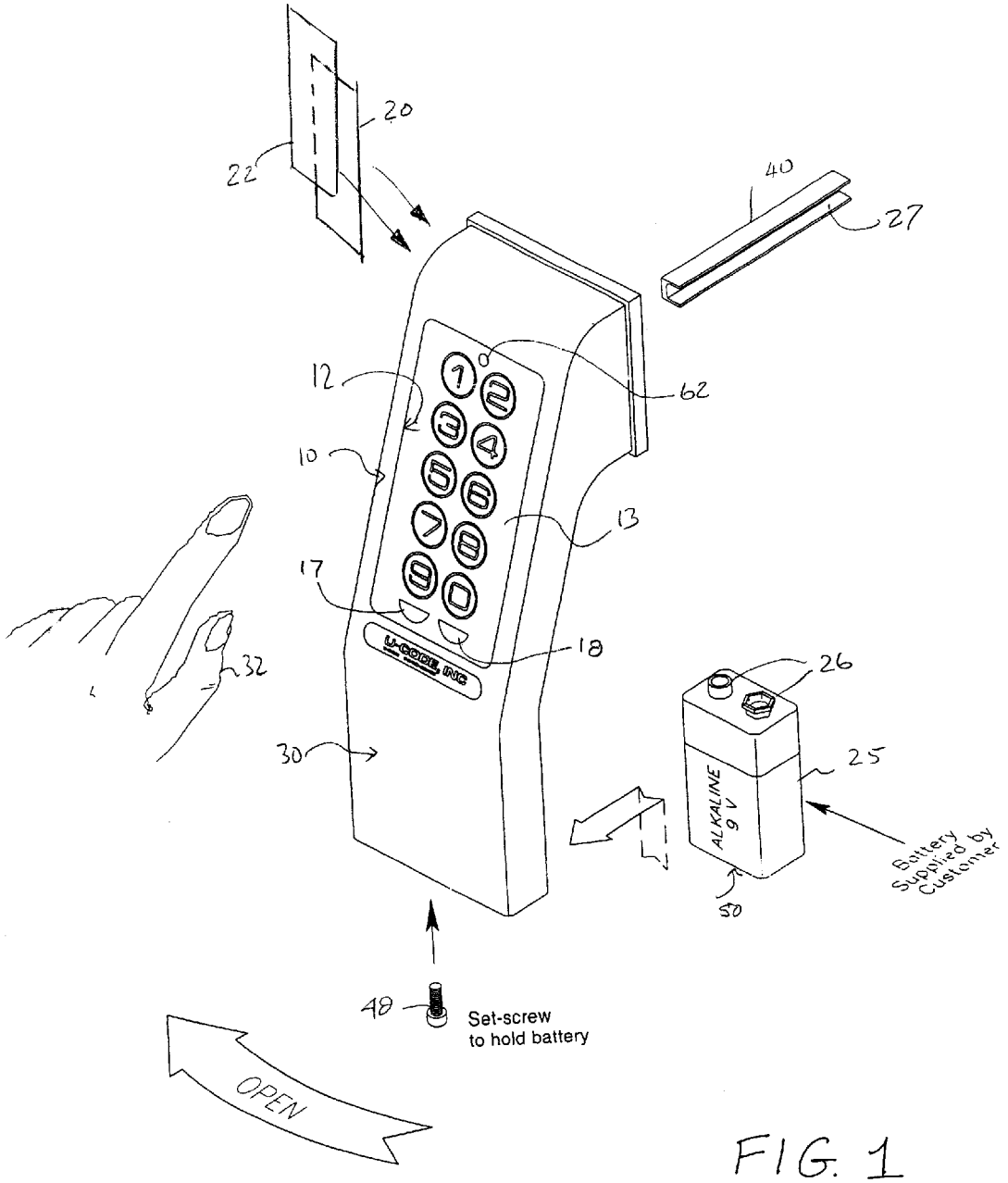
FIG. 1 is a perspective view of the electronic combination lock showing a pistol shape handle having a digital keypad. The handle is connected to a spindle to operate bolts, and the handle movement is powered by a battery pack.
Figure 2:
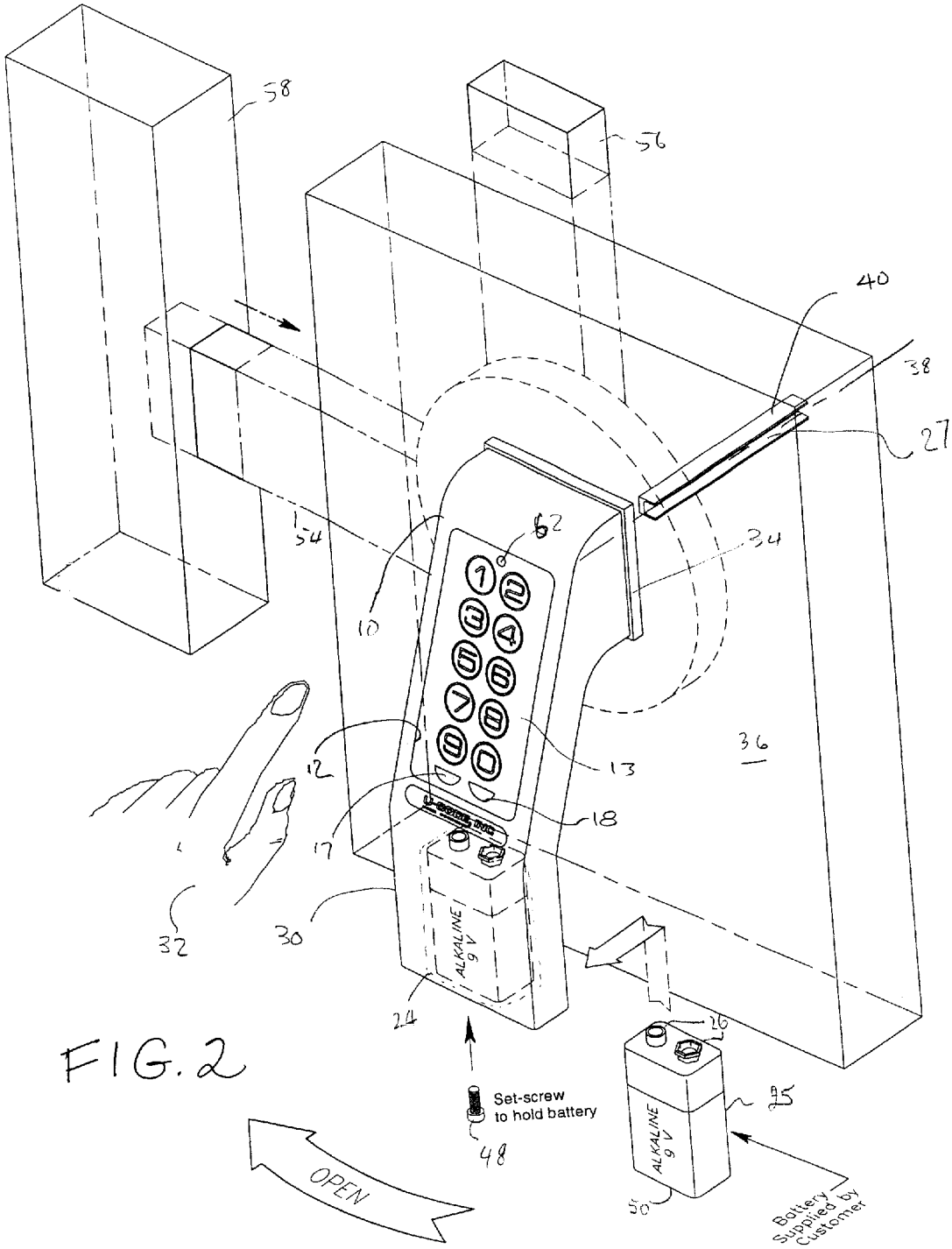
FIG. 2 is a perspective view of an electronic combination lock in relation to a structure on which the lock is mounted and wherein there are two bolts orthogonally arranged.
Figure 3:
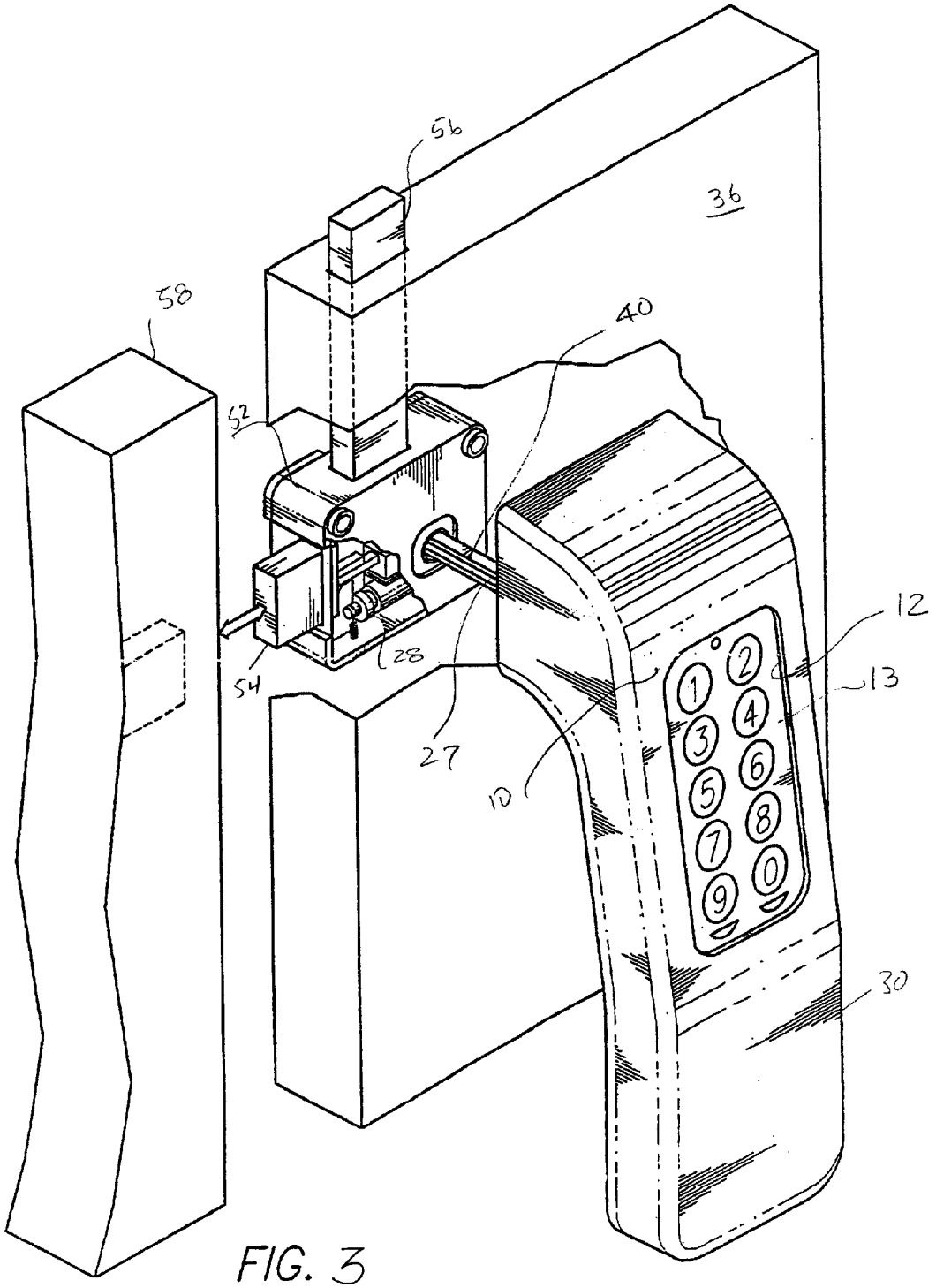
FIG. 3 is a perspective view showing the bolt mechanism with a spindle from the lock handle interacting with the bolt activation mechanism.
Figure 4:
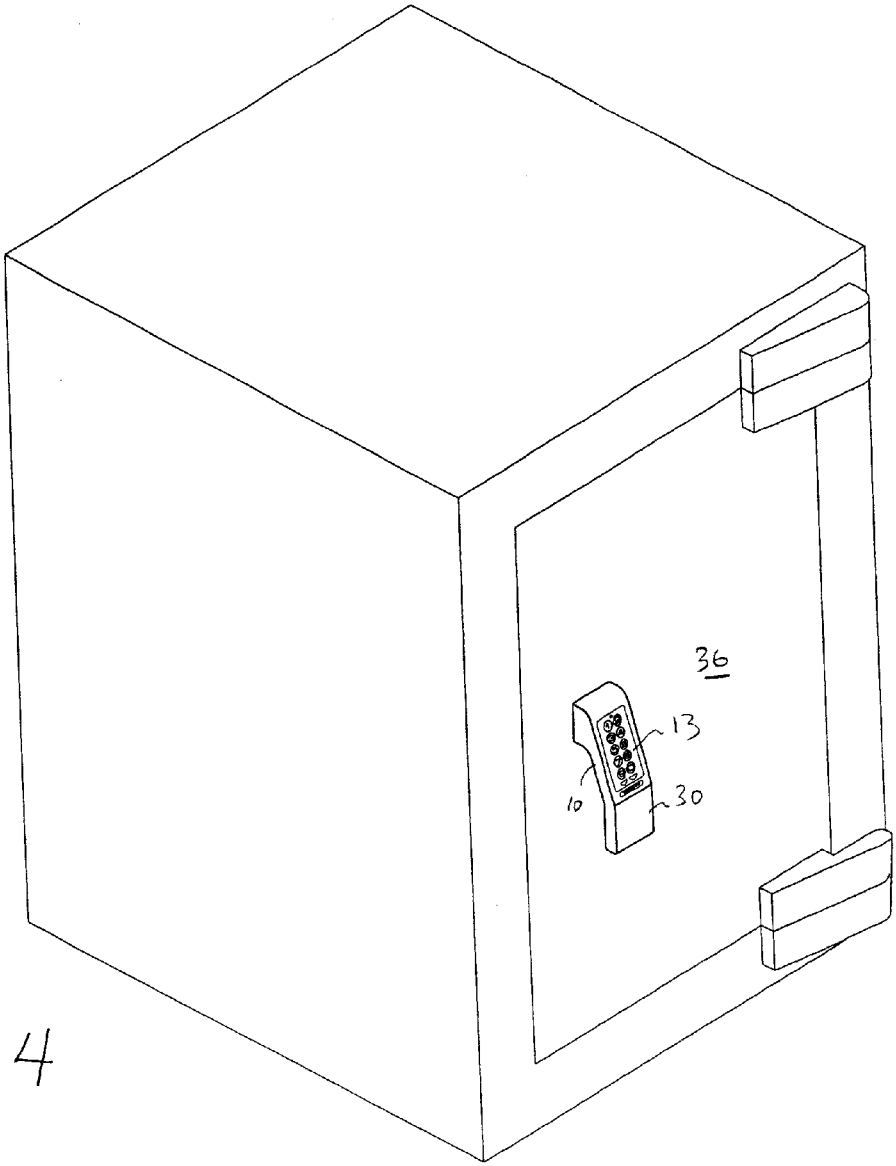
FIG. 4 represents a perspective of the lock in the closed position on a safe.
Figure 5:
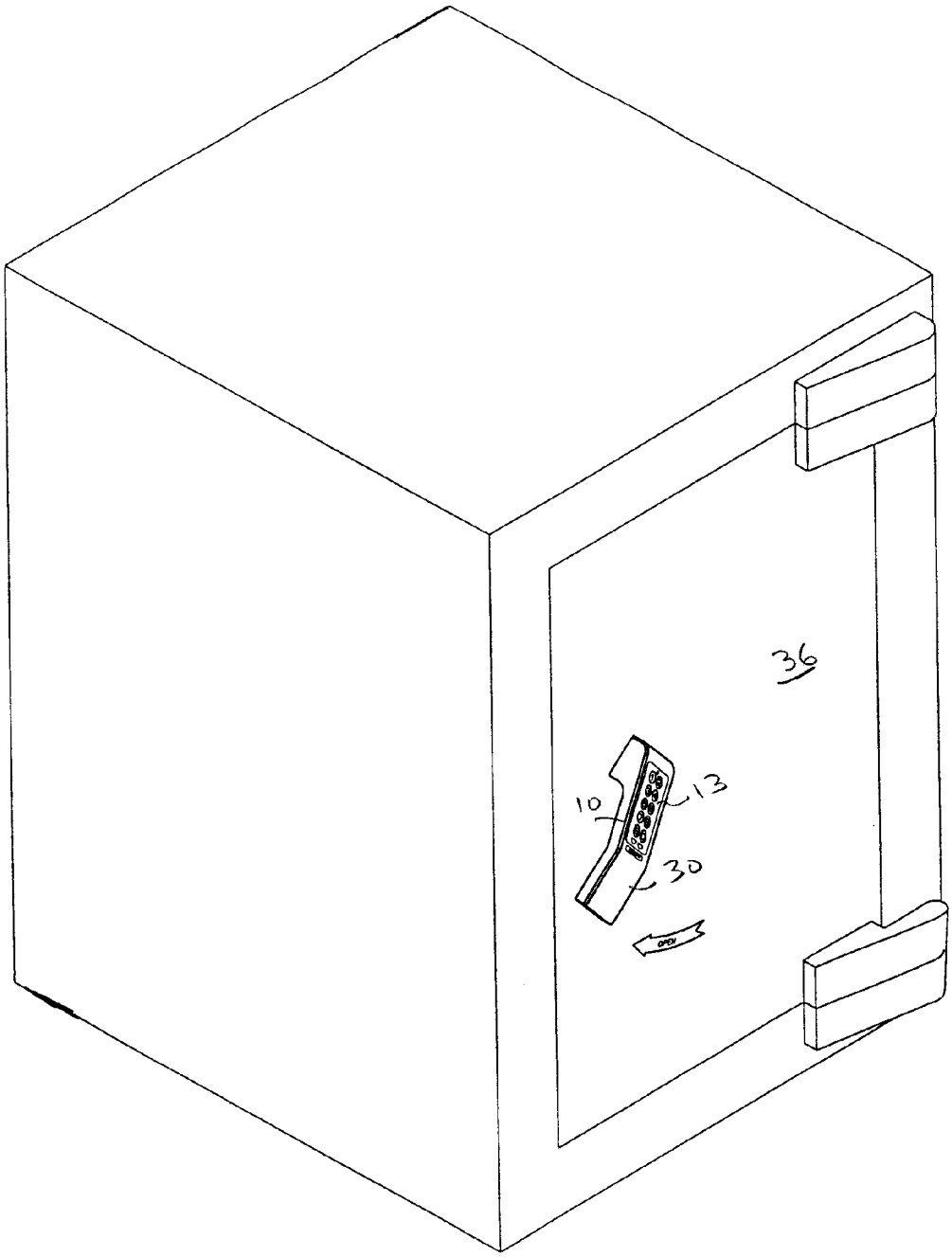
FIG. 5 is a representation of a safe with a lock mechanism in the open position.
Figure 7:
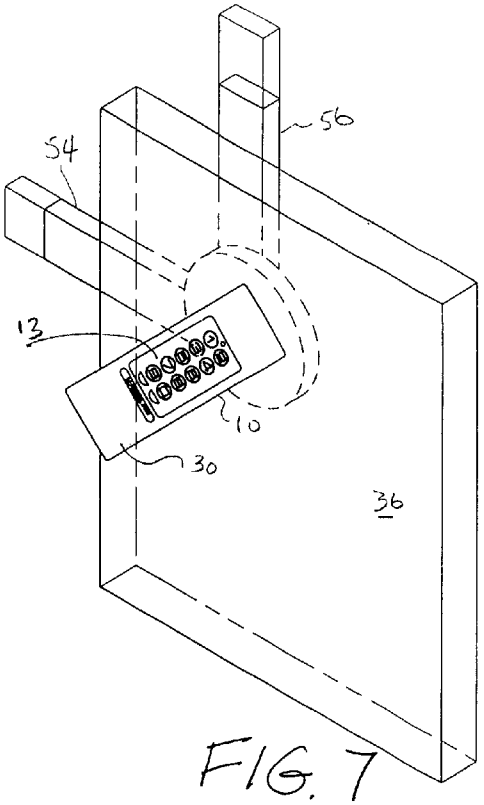
FIG. 7 is a representation of the lock with the bolts in the retracted unlocking position.
Figure 6:
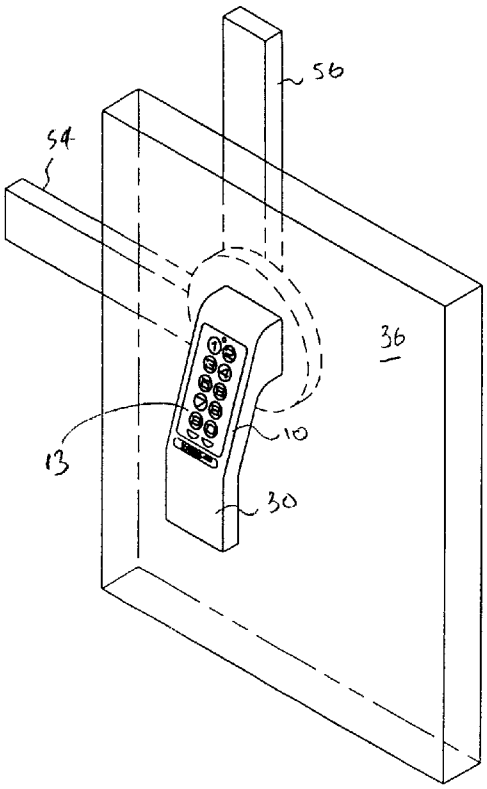
FIG. 6 is a representation of the lock with the bolts in the extended locking position.

The following specification describes an electronic lock with a digital keypad incorporated into the handle. In the description, specific materials and configurations are set out in order to provide a more complete understanding of the present invention. But it is understood by those skilled in the art, that the present invention can be practiced without those specific details. In some instances, well-known elements are not described precisely so as not to obscure the invention.

The present invention relates to an electronic combination lock handle disposed on a door. There is a handle having a keypad with keys bearing indicia for entering a combination code. A shaft or spindle is rotated by the handle mounted to the door, and multiple bolts having an extended position and a retracted position, are selectively operated by rotation of the handle. An orientation of the indicia and/or the position of the pistol grip of the handle selectively indicates the extended position or retracted position of the bolts.

Specifically, upon receipt of a proper code, a controller provides a control signal that triggers the release of the spindle so as to permit rotation about an axis, thereby the bolt blocking device can either lock or unlock the bolts. This enabled movement of the bolts by rotation of the handle permits the bolts to be moved to the extended or retracted positions as the case may be. In some rotations the correct code is used only to permit unlocking. No code may be needed for effecting locking.

A combination lock handle for mounting on a door comprises a pistol grip handle having a pressure-sensitive keypad on a face of the pistol grip, the face being visible to a user, and the keypad including indicia for entering a code to operate a lock. There is a transducer in an interior of the pistol grip handle, the transducer being connected to the keypad to provide a code signal. A controller receives the code signal from the transducer and provides a control signal. At least one bolt is movable relative to the pistol grip handle. A bolt-locking mechanism is operable between a bolt-locking and a bolt-release condition through entry of a lock-opening combination by digital input of a predetermined code though the keypad to electronically operate the lock mechanism.

A first and second orientation of the pistol grip handle respectively indicate a locked and unlocked condition of the bolt or bolts.

A lock body housing 10 includes a receptacle area 11 with a window-like portion 12, for receiving a keypad face 13 with a series of numerals and/or alphabetic characters and/or a thumb or finger print indicia pad that can provide for the different combination or code for operating an electronic lock. The indicia can be numbers, letters, symbols, and/or like alpha-numeric representations.

Behind the keypad face 13, which is the input, there is a touch-sensitive electrical element 22, which responds to pressure on the keypad 13. This is the transducer 22, which can include membrane-covered switches. There is a suitable circuit board response to pressure, touch or coding for the indicia. On the keypad, there are cells 15, for the character or indicia locations. On the keypad 13, there are two conductor areas 17 and 18. The appropriate terminals from a battery can be manually applied to touch the areas 17 and 18, as necessary.

There is a battery housing 24, wherein there is located a battery 25, which can be rechargeable, if necessary. The terminals 26 from the battery 25 connect with a cable or other conductor to the circuit board 20 and/or touch keypad 13 and/or transducer 22.

The lock body housing 10 includes a form of a pistol handle 30 which extends from the lock portion 10. The handle 30 is for gripping by the hand 32 to turn the lock portion 10 and pistol grip 30 about an axis 38 running approximately centrally through the base 34 of the lock portion 10. The base 34 of the housing engages on a support or door 36 in flush relationship, and is suitably bolted on the door. Rotational axis 38 is shown in a position relative to the support 36 and there is a spindle 40 which is mounted to pass into the lock portion 10.

When the correct combination is keyed or entered or pressed into the keypad 13 of lock portion 10, the lock body portion 10 and handle 30 can be moved from the closed to the open position as required. This causes the spindle 40 to turn about the axis 38 as necessary.

The housing 24 is internally formed for receiving a battery 25 with terminals 26 in the pistol grip 30. Set screw 48 acts against the base 50 of the battery 25, and causes the battery 25 to be urged forwardly and positively so that the battery 25 and the terminals 26 are in a firm location. The battery 25 is firmly anchored in the housing 24 within the pistol grip 30 and is secure in position.

Turning the spindle 40 causes the bolt mechanism 52 to operate so that bolts 54 and 56 can move between retracted and extended positions as indicated. Bolt 54 would engage a jam 58 and bolt 56 would engage a jam 60 to be in the bolted position. By having the double bolt action a secure locking arrangement is created. The actual bolt activating mechanism 52 can be of any different direct or indirect means for moving the one or more bolts 54 or 56 between the retracted and non-retracted position. These kinds of mechanisms are well known to those skilled in the art and can include different gears, interacting cams or the like as necessary. The rotational movement of the spindle is translated into linear movement of the bolts 54 and 56 by this mechanism 52.

A circuit board 20 sends a signal in response to the code from transducer 22 to permit release of the spindle 40 to rotate about the axis 38. The control for movement of the spindle 40 can be either in the bolt activation mechanism or in a similar mechanism in the lock portion 10. The printed circuit board 20 generates an electrical control signal to operate the lock. The printed circuit board 20 may carry a microprocessor with a nonvolatile random access memory, known in the art. The control signal can be conveyed via a cable to a solenoid 28 located inside the lock activation mechanism 52 or similar mechanism in the lock portion 10. The solenoid 28 is preferably an electromagnetically operated bolt blocking device that moves into a blocked or unblocked position relative to the spindle 40 based on whether an inductor in the solenoid is energized or not.

The locking mechanism receives the rotatable shaft or spindle 40 extending for engagement directly or indirectly with the bolts 54 and 56. Rotation of the shaft 40 acts to move the bolts inwardly and outwardly between a locking and bolt-released condition. There can be a formation in the periphery of the spindle or shaft 40 for engaging an armature of an electronically operable solenoid. When the formation engages an armature of the solenoid, it is prevented from rotating. An electrical power source can be connected to the solenoid and controller for the solenoid. When the formation engages the spindle or shaft 40 to keep the bolts 54 and 56 in the closed position, the spindle or shaft 40 cannot be rotated, and the pistol grip handle is in a first orientation. When the formation disengages from the shaft 40, the bolts are moved to the open position by rotating the pistol grip handle 30. This movement of the pistol grip handle 30 is moved to a second orientation.

The solenoid can be mounted relative to the rotational shaft such that the armature can move upwardly and downwardly into engagement with the rotatable shaft, and wherein selectively the downward movement is under the action of at least one of a spring and/or gravity. Alternatively, it can be side ways mounted.

The face of the lock 13 also has a LED 62 for indicating the status of the lock, the battery, and keypad 13. The effectiveness of the combination or code or fingerprint is inputted to the keypad 13.

The circuitry which is responsive to the inputting of the code combination and fingerprint is conventional in the art.

It can include a suitable microprocessor system for decoding input signals. The other electronics can be programmed appropriately to receive new codes.

There are many other examples of the invention, each differing from other in matters of detail only. In one situation there can be only a single bolt mechanism, or there can be two or three bolts each directed in the same or different directions. The spindle or shaft 40 can include an optional channel 27 extending the length thereof. The channel 27 can carry an electrical cable interconnecting circuitry in the lock 10 to the bolt activation mechanism 52.

Although the invention is directed to including the input code combination or key on the pistol grip of the lock on its face, there could be situations where the keypad is on a face different from the front face. For instance, the side face may be equally appropriate or in certain situations the code could be on the rear of the pistol grip, particularly where the code could be a fingerprint and that the handling of the lock by the gripping of a person's finger may effectively cause operation of the lock. In this situation the coded keypad face is hidden from normal view. A suitable indentation can be provided for receiving a finger or thumb. This indentation could be provided within the code on the front face, the side or the rear of the pistol grip. The keypad can be on the pistol grip handle portion. The fingerprint recognition system is well known in the art, and may or may not be a pressure-sensitive recognition system. Indeed, appearance recognition, unrelated to pressure, could be an operational system.

There can be a manual override provided for the lock in appropriate circumstances. An electromagnetically operated bolt blocking device is used to selectively block and unblock movement of the bolt based on a controller receiving the proper code entered from the keypad.

Specifically, upon receipt of a proper code, a controller provides a control signal that can trigger the bolt inactivation devices to unblock the bolts, thereby enabling movement of the bolts by rotation of the handle to displace the bolts to the retracted position.

The present invention is useful in a variety of applications. Therefore, the door 22 may be part of a safe, a hotel room door, a locker door, a security gate, a lock box, a vault door, a front door of a residence, etc.

The invention is to be determined solely by the following claims.

What is claimed is:

1. In a combination lock for mounting to a container wherein the container has an outside and an inside and a door for access to the inside of the container, the combination lock comprising:

A combination lock mechanism within the container, the combination lock restricting opening of the door for access to the inside of the container, the combination lock mechanism having a bolt movable between a locked condition for preventing access to the inside of the container and an unlocked condition for permitting access to the inside of the container, the lock mechanism having an electric device, the electric device having a locked condition that selectively block movement of the bolt to the unlocked position and an unlocked condition that permits bolt movement to the unlocked position;

an elongated lock handle on the outside of the container, the lock handle having a pressure sensitive keypad on a first face of the lock handle, the face being visible to a user, the lock handle having a portion in contact with the door and a portion depending from the portion in contact with the door;

a controller in an interior portion of the handle portion and being electrically connected to the keypad, the controller receiving signals from the key pad and providing a control signal to the electric device upon entry of a lock-opening combination by input of a predetermined code through the keypad;

a shaft extending from the lock handle and engaging the lock mechanism, the shaft being operably connected to the bolt, rotation of the shaft acting to move the bolt between a locking and bolt-released condition;

a power source electrically connected to the electrical device and the controller;

a housing for the power source in the depending portion of the lock handle; and a cover over the housing for the power source mounted to a face of the lock handle opposite the first face.

2. The combination lock of claim 1, wherein the keypad further comprises an electrical contact connected to the power source.

3. The combination lock of claim 1, wherein the keypad further comprises an indicator showing a low power level condition of the power source.

4. The combination lock of claim 1, wherein the power source includes a battery.

5. The combination lock of claim 1 wherein the shaft has a formation in the periphery of the shaft, the formation engaging part of the electric device when the electric device is in its locked condition to prevent the shaft from rotating.

6. The combination lock of claim 1, wherein the electric device is a solenoid.

7. The combination lock of claim 1 wherein the entry pad is a key pad having a plurality of keys.

8. In a combination lock handle for mounting to a container wherein the container has an outside and an inside and a door for access to the inside of the container and a combination lock mechanism within the container, the combination lock restricting opening of the door for access to the inside of the container, the combination lock mechanism having a bolt movable between a locked condition for preventing access to the inside of the container and an unlocked condition for permitting access to the inside of the container, the lock mechanism having an electric device, the electric device having a locked condition that selectively blocks movement of the bolt to the unlocked position and an unlocked condition that permits bolt movement to the unlocked position, the combination lock handle comprising:

an elongated lock handle on the outside of the container, the lock handle having a pressure sensitive keypad on a first face of the lock handle, the face being visible to a user, the lock handle having a portion in contact with the door and a portion depending from the portion in contact with the door;

a controller in an interior portion of the handle and being electrically connected to the keypad, the controller receiving signals from the key pad and providing a control signal to the electric device upon entry of a lock-opening combination by input of a predetermined code though the keypad;

a shaft extending from the lock handle adapted to engage the lock mechanism, the shaft being operably connected to the bolt, whereby rotation of the shaft acting to move the bolt between a locking and bolt-released condition;

a power source adapted to be connected electrically to the electrical device and the controller;

a housing for the power source in the depending portion of the lock handle;

a cover over the housing for the power source mounted to a face of the lock handle opposite the first face.

9. The combination lock handle of claim 8 wherein the shaft has a formation in the periphery of the shaft, the formation adapted to engage part of the electric device when the electric device is in its locked condition to prevent the shaft from rotating.

10. The combination lock handle of claim 8 wherein the entry pad is a key pad having a plurality of keys.

11. The combination lock handle of claim 8, wherein the keypad further comprises an electrical contact connected to the power source.

12. The combination lock handle of claim 8, wherein the keypad further comprises an indicator showing a low power level condition of the power source.

13. The combination lock handle of claim 8, wherein the power source includes a battery.

* * * * *